US008931450B2

(12) United States Patent
Bender et al.

(10) Patent No.: US 8,931,450 B2
(45) Date of Patent: Jan. 13, 2015

(54) CAMSHAFT ASSEMBLY AND METHOD FOR PRODUCING A CAMSHAFT ASSEMBLY

(75) Inventors: Stefan Bender, Engen (DE); Thomas Schiepp, Seitingen-Oberflacht (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/005,755

(22) PCT Filed: Mar. 12, 2012

(86) PCT No.: PCT/EP2012/054234

§ 371 (c)(1),
(2), (4) Date: Sep. 17, 2013

(87) PCT Pub. No.: WO2012/126756

PCT Pub. Date: Sep. 27, 2012

(65) Prior Publication Data

US 2014/0007828 A1 Jan. 9, 2014

(30) Foreign Application Priority Data

Mar. 18, 2011 (DE) ..... 10 2011 001 420

(51) Int. Cl.

| | |
|---|---|
| ***F01L 1/34*** | (2006.01) |
| ***F01L 1/344*** | (2006.01) |
| ***F01L 1/047*** | (2006.01) |
| *F01L 13/00* | (2006.01) |

(52) U.S. Cl.

CPC ..... *F01L 1/344* (2013.01); *F01L 1/047* (2013.01); *F01L 2001/0475* (2013.01); *F01L 2001/3443* (2013.01); *F01L 2001/34433* (2013.01); *F01L 2013/0052* (2013.01); *F01L 2820/031* (2013.01)

USPC ..... 123/90.17; 123/90.11; 123/90.15; 123/90.6; 29/888.1

(58) Field of Classification Search

USPC ..... 123/90.11, 90.15, 90.17, 90.6; 29/888.1

See application file for complete search history.

(56) References Cited

U.S. PATENT DOCUMENTS

| | | | |
|---|---|---|---|
| 7,243,626 | B2 | 7/2007 | Strauss et al. |
| 7,597,076 | B2 | 10/2009 | Strauss et al. |

(Continued)

FOREIGN PATENT DOCUMENTS

| | | | |
|---|---|---|---|
| DE | 102006031517 | A1 | 1/2008 |
| EP | 1596040 | A2 | 11/2005 |

(Continued)

*Primary Examiner* — Ching Chang

(74) *Attorney, Agent, or Firm* — Bachman & LaPointe, P.C.

(57) ABSTRACT

A camshaft assembly, comprising a camshaft (2) having a receiving space (6) in an interior thereof, at least some sections of the assembly being made of a magnetizable material, and an electromagnetic actuating unit (4) for actuating an actuating partner (5), comprising a control valve of a camshaft adjuster (3), a coil winding (8) and an armature (7) for cooperating with the actuating partner (5), the armature being adjustable by energizing the coil winding (8). The armature (7) is arranged at least in some sections, preferably completely, inside the camshaft (2) in the receiving space (6) and the coil winding (8) for the non-contact adjustment of the armature (7) is arranged radially outside the camshaft (2), and the camshaft (2) has a first axial section (9) and a second axial section (10), between which a material region (11) influencing the magnetic flow (12) is provided in order to increase the magnetic flow (12) from one of the axial sections (9, 10) to the respective other axial section (9, 10) via the armature (7).

15 Claims, 1 Drawing Sheet

(56) References Cited

U.S. PATENT DOCUMENTS

| | | | | |
|---|---|---|---|---|
| 8,061,310 | B2 * | 11/2011 | Watanabe | 123/90.15 |
| 8,402,934 | B2 | 3/2013 | Bender | |

FOREIGN PATENT DOCUMENTS

| | | | |
|---|---|---|---|
| EP | 2252774 | B1 | 10/2011 |
| JP | 2010190060 | A | 9/2010 |

* cited by examiner

CAMSHAFT ASSEMBLY AND METHOD FOR PRODUCING A CAMSHAFT ASSEMBLY

BACKGROUND OF THE INVENTION

The invention relates to a camshaft assembly, comprising a camshaft having a receiving space in its interior, i.e. constructed at least partially as a hollow shaft, at least partially, in particular in the region of an electromagnetic actuating unit, of a magnetisable (flux-conducting) material, for an internal combustion engine and an electromagnetic actuating unit for the actuation of an actuating partner, in particular a control valve of a, preferably hydraulic, camshaft adjuster, with a coil winding and an armature which is adjustable by energizing the coil winding for cooperating with the actuating partner. The invention further relates to a method for producing such a camshaft assembly and also an engine block.

A camshaft assembly, comprising a hydraulic camshaft adjuster, is described in EP 1 596 040 A2. The camshaft adjuster serves to set the point in time of opening or closing of gas exchange valves of the internal combustion engine.

In DE 10 2006 031 517 A1 an alternative camshaft assembly is described, comprising a camshaft adjuster, the control valve of which is adjustable by means of an electromagnetic actuating unit. The electromagnetic actuating unit of the known camshaft assembly is arranged on the front side of the camshaft and cooperates axially with the control valve of the camshaft adjuster which is arranged in the camshaft.

From EP 2 252 774 B1 a camshaft assembly is known, in which the coil winding for actuating an armature cooperating with a control valve of a camshaft adjuster is arranged in a housing outside the engine block, and namely with axial distance from the camshaft which is received completely in the engine block. Fixed on this is a yoke- and core unit projecting into the housing for the coil winding, wherein the yoke and core of the yoke- and core unit are connected with one another via non-magnetic material. A disadvantage in the known camshaft assembly is that this has a comparatively high installation space requirement.

Attempts exist to reduce the high installation space requirement of camshaft assemblies.

The invention is therefore based on the problem of indicating an alternative camshaft assembly, the installation space requirement of which is reduced, in particular in the region of the front side of the camshaft. In addition, the problem consists in indicating a method for producing a camshaft assembly which is optimized in such a way with regard to installation space.

SUMMARY OF THE INVENTION

The camshaft assembly and the method for producing such a camshaft assembly attain the object of the invention.

Advantageous further developments of the invention are indicated in the description. To avoid repetitions, features disclosed with regard to the device are to be deemed to be disclosed with regard to the method. Likewise, features disclosed with the regard to the method are to be deemed to be disclosed with regard to the device.

The invention is based on the idea of arranging the armature, at least partially, preferably completely, within the camshaft, which is constructed at least partially as a hollow shaft, i.e. to arrange it in a receiving space formed in the interior of the camshaft and the coil winding for adjusting the armature radially spaced apart from the armature, and namely outside the camshaft. In order to generate a sufficiently powerful magnetic flux from the coil winding to the armature and back again on energizing of the coil winding, provision is made according to the invention that the camshaft has a first and a second axial section, between which a material region influencing the magnetic flux is provided, which is suitable and designed to increase the magnetic flux from one of the axial sections to the respectively other axial section (by comparison with an embodiment without such a material region) via the armature and via the air reservoir, if applicable filled with oil, provided between the inner circumference of the camshaft and the armature. The material region is therefore provided such that it "forces" the magnetic flux, at least for the most part, most particularly preferably entirely, from one of the axial sections to the armature and from the armature to the respectively other axial section, i.e. such that the magnetic flux crosses over the distance between the axial sections and the armature and takes the "detour" via the armature. Hereby, a space-saving construction, optimized with regard to efficiency, of the electromagnetic actuating unit is obtained. Theoretically it would be conceivable to construct the camshaft, which is preferably free of radial aperture, from a non-magnetisable material, in order to therefore dispense with two axial sections spaced apart over a material region—however this alternative solution would have the disadvantage, owing to the large magnetically non-conducting radial distance between coil winding and armature, that a comparatively large-dimensioned coil winding would have to be used, in order to ensure an adjustment of the armature. In contrast to this, a camshaft assembly according to the invention manages with a comparatively small-dimensioned coil winding, so that the camshaft assembly according to the invention is optimized with regard to installation space not only in axial direction but also in radial direction.

Preferably, a yoke- and core unit axially adjoining the camshaft is dispensed with, because this function is undertaken by the first and the second axial section of the camshaft.

An embodiment is preferred in which the camshaft is arranged completely within an engine block. Further preferably, the armature and the coil winding are also situated completely within the engine block and not, as in the prior art, on a housing fixed externally to the engine block, which housing, according to a further development, is preferably completely dispensed with.

It is most particularly preferred if in radial direction the region influencing the magnetic flux does not project over the axially adjacent camshaft sections or respectively over the, preferably shared, cylindrical covering contour thereof.

In order to bring about an optimum influencing of the magnetic flux in the previously described manner, provision is made in further development of the invention that the material forming the material region, i.e. the material which is comprised in the material region or of which this consists, is not magnetically conductive or is at least less magnetically conductive than the (other) material of the camshaft. In this context, it is defined that the magnetisable material of the camshaft according to the claim is to be understood to be the material or the material combinations of the camshaft adjacent to the material region influencing the magnetic flux, i.e. the material or materials from which the axial sections are formed. Through the construction of the material region, influencing the magnetic flux, from a non- or at least less magnetisable material, preferably metal, for example bearing materials, such as e.g. brass, an optimum magnetic separation is achieved between the two axial sections. This magnetic separation can be realized completely or only partially, depending on whether the two axial sections are connected with one another exclusively via the material region influencing the magnetic flux, or whether in addition to the material region a material bridge of camshaft material is provided. The quality or respectively the extent of the magnetic separation is also influenced by the choice of material of the material region, i.e. whether non-magnetisable material or only difficultly magnetisable material is used.

In the present application, "magnetisable" is understood in the sense of "flux-conducting", i.e. a magnetisable material is flux-conducting, whereas a difficultly magnetisable material is more poorly flux-conducting, i.e. the difficultly magnetisable material presents a great resistance to the magnetisable flux. Non-magnetisable material is not flux-conducting. "Magnetisable" therefore does not mean a possible remanence (magnetisability) of the material, but rather that a significant magnetising of the material occurs under external magnetic field.

It is preferred if the camshaft, preferably at least in the region of the actuating unit (actuator region) is constructed from magnetisable (flux-conducting) material, in particular from a suitable steel.

Most particularly preferred is a variant embodiment in which the first and the second axial section, in particular exclusively, are connected securely with one another mechanically via the material region. This can be realized in particular in that the first and the second axial section are connected with one another by welding, in particular build-up welding with the use of material which is not magnetically conductive or is little magnetically conductive. Alternatively to a welding process, it is conceivable that the material region is formed by a soldering material which indeed connects the material sections securely with one another mechanically, but in contrast to a welding process produces no materially connected, but nevertheless a mechanically secure connection. Preferably, after the welding or soldering, the camshaft surface area (surface) is processed, in particular smoothed, for example by turning and/or grinding.

For example as an alternative to applying an additional material, in particular a soldering or welding material for the construction of the material region, it is possible to realize or respectively form the material region by a material change in a section axially between the two axial sections of the camshaft. This can be achieved for example by partial heat treatment, in particular annealing or other methods for microstructural transformation.

A further alternative production possibility consists in providing as the material region, influencing the magnetic flux, between the first and the second axial section an annular component or respectively a hollow-cylindrical component of a non or poorly magnetically conducting material, for example brass, which is connected in a suitable manner, for example by friction welding, with the two axial sections, preferably with the front sides of the axial sections which face one another.

It is particularly preferred if the material region between the two axial sections of the camshaft is produced by filling a free space with preferably non-magnetisable or poorly magnetisable material, wherein the free space may be a recess, in particular a circumferential groove in the camshaft, that therefore next to the free space, in particular radially inwardly adjacent, a connection, preferably as thin as possible, of camshaft material remains between the two axial sections of the camshaft. Alternatively, the free space can concern a complete separation, i.e. a radially continuous, in particular circumferentially closed gap or respectively axial distance between the two axial sections of the camshaft. As will also be seen in the explanation of the method according to the invention or respectively of a preferred variant embodiment of the method, it is particularly expedient if the production of the free space takes place by producing a recess or complete separating of the two axial sections of the camshaft in the same clamping, so that the two axial sections remain positioned precisely with respect to one another and no renewed relative positioning is necessary.

As already explained, it is particularly expedient if the free space is filled by build-up welding, wherein in this case the non-conducting or poorly conducting magnetic material is applied in a fluid, heated state.

As already previously indicated, it is basically conceivable that the two axial sections of the camshaft are held against one another not exclusively via the material region of non- or poorly magnetisable material, but rather that immediately adjoining the material region, in particularly radially inside, an axial, preferably annular, still more preferably as thin as possible—i.e. having as small a radial extent as possible—connecting web or respectively connecting ring is provided. Preferably, this connecting section, in particular annular section, is designed to be so thin or respectively is provided with such a thin cross-section in radial direction that on energizing of the coil winding (quickly) a magnetic saturation is reached, whereby negative effects of the magnetisable connecting section on the efficiency of the electromagnetic actuating unit are minimized.

An embodiment is particularly preferred, in which the camshaft is constructed at a maximum in two parts, except for the region influencing the magnetic flux, i.e. comprises no more than two parts. A one-part configuration is possible if the two axial sections, as previously described, are connected with one another via a material bridge or the region influencing the magnetic flux is produced by microstructural transformation of a camshaft section. In a two-part embodiment, the two axial sections are connected with one another (preferably exclusively) via the material region influencing the magnetic flux.

Further preferably, the camshaft has an axially continuous cylindrical outer contour.

There are various alternatives with regard to the geometric configuration of the non- or only poorly magnetisable material region. Basically, it is possible to provide the material region with a contour which is rectangular in cross-section. It is particularly expedient, in particular in order to obtain as large as possible connecting- or respectively fixing surfaces between the axial sections and the material region, if the connecting surfaces or respectively holding surfaces between the material region and the axial sections are constructed so as to be oblique. This can be achieved for example in that the axial extent of the material region decreases over its radial extent, i.e. viewed in the direction of the armature.

In order to achieve as good a magnetic separation as possible between the two axial sections, it is preferred if the material region of non- or difficultly magnetisable material is circumferentially closed, i.e. constructed in an annular shape.

There are several alternatives with regard to the arrangement of the coil winding. According to a particularly preferred variant embodiment, the coil winding is arranged coaxially to the camshaft, therefore surrounds the latter in an annular shape. Alternatively, the coil winding is arranged next to the camshaft, preferably such that a coil winding axis runs parallel to the camshaft. It is also conceivable to provide several coil windings arranged adjacent to one another in circumferential direction, i.e. distributed over the circumference of the camshaft.

According to the invention, the armature is received at least partly in the camshaft, more precisely in the receiving space provided in the camshaft, preferably delimited by the latter. It is particularly expedient with regard to an optimized required space if the armature is arranged over the greatest part of its axial extent, preferably completely in the camshaft. Likewise, it is preferred if the actuating partner, in particular a control valve of a camshaft adjuster, with which the armature cooperates, is received at least partially, preferably completely in the camshaft. It is particularly expedient if the actuating partner projects at least axially from a front side into the camshaft.

The invention also specifies a method for the production of a camshaft assembly according to the invention. It is the core of the invention that in an (intermediate) region between a first axial section and a second axial section of a camshaft a material region is provided, preferably securely connecting the two axial sections mechanically with one another, so that thereby a magnetic flux guidance is brought about, in which the magnetic flux is increased from one of the axial sections of the camshaft to the respectively other axial section via the armature (compared with a variant embodiment without such a material region).

There are various possibilities with regard to the production of the material region. It is particularly preferred to produce the material region by filling, for example by means of build-up welding, a free space between the two axial sections with a material which is not magnetisable or is at least less easily magnetisable than the material of the two axial sections of the camshaft. Preferably, the two axial sections of the camshaft consist of the same material. A variant embodiment is also basically conceivable, in which the two camshaft axial sections consist of different materials.

Before the filling of the free space, the latter is preferably produced, alternatively by machining of a camshaft blank, for example by introducing a groove or by separating a previously one-piece camshaft body blank, wherein it is particularly preferred if the production of the free space takes place in the same clamping as the filling of the free space, in order to avoid a renewed positioning of the two axial sections in the case of the complete separation.

Alternatively, it is possible to position two camshaft body blanks, which later form the two axial sections of the camshaft, whilst maintaining the free space, and thereupon to fill the free space with in particular non- or at least less easily magnetisable material, for example by build-up welding.

According to an alternative production variant of the material region, preferably no free space is filled, but rather the originally magnetisable material of the camshaft body blank is partially processed (altered), so that the material in the later material region becomes non- or at least less easily magnetisable than the material of the first and/or second axial section. For this, the material in the subsequent material region is processed for example partially by heat treatment.

BRIEF DESCRIPTION OF THE DRAWINGS

Further advantages, features and details of the invention will emerge from the following description of preferred example embodiments and with the aid of the drawings.

These show in.

In the Figures, identical elements and elements having the same function are characterized by the same reference numbers.

DETAILED DESCRIPTION

Figure 1:
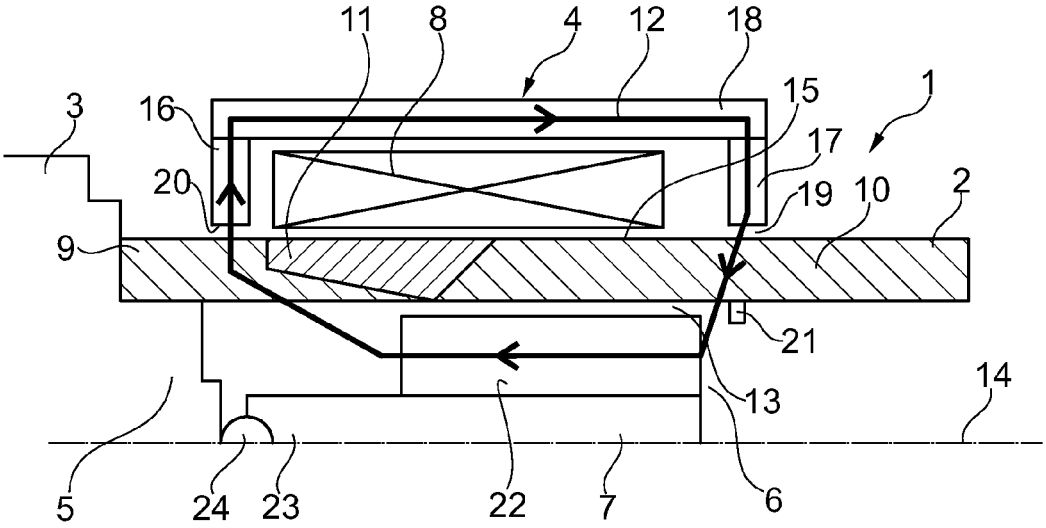
FIG. 1 in a highly diagrammatic section view, only illustrated by half, a camshaft assembly in which two axial sections of the camshaft are connected securely with one another axially exclusively via a material region of non-magnetisable material, and FIG. 2 an alternative variant embodiment of the camshaft assembly, in which the two axial sections, in addition to the material region, are connected with one another via an annular connecting section of camshaft material, wherein the radial extent of this connecting region is selected so that this region is magnetically saturated rapidly on the energizing of a coil winding.

In FIG. 1 in a diagrammatic longitudinal section view a camshaft assembly is shown having a hollow camshaft of a magnetisable material, steel here, and a hydraulic camshaft adjuster 3, an electromagnetic actuating unit 4 and an actuating partner 5 for the electromagnetic actuating unit in the form of a control valve of the camshaft adjuster 3. The camshaft adjuster 3 together with actuating partner 5 (control valve) is arranged and fixed on the camshaft 2 in a manner known per se. A camshaft adjuster housing, not illustrated separately, is connected directly or indirectly with a crankshaft, likewise not illustrated, of the internal combustion engine, likewise not illustrated and is driven thereby. In addition, the camshaft adjuster 3 has adjustment elements, not shown, connected with the camshaft 2, which adjustment elements can be twisted relative to the camshaft adjuster housing in a manner known per se by a hydraulic actuation. The twisting of these adjustment elements brings about a phase adjustment of the camshaft 2 relative to the crankshaft.

The electromagnetic actuating unit 4 comprises an armature 7 arranged in the camshaft 2, more precisely in a receiving space 6 of the camshaft 2, which armature is mounted axially displaceably and is adjustable in axial direction of the camshaft 2 by energizing of a coil winding 8 arranged radially outside and at a distance from the camshaft 2. The armature 7 is arranged axially adjacent to the actuating partner 5, which is alternatively arranged completely in the camshaft 2 and projects axially into the latter. It is also conceivable that the actuating partner is situated outside the camshaft 2 and the armature 7 projects somewhat from the camshaft 2.

As explained, the actuating partner 5 is a control valve of the camshaft adjuster 3, wherein the camshaft adjuster 3 can be activated by means of the control valve, by the adjusting causative hydraulic fluid being supplied to the hydraulic camshaft adjuster 3 by the control valve (actuating partner 5) in a quantity necessary for the desired adjustment and the necessary pressure. The adjustment elements of the camshaft adjuster 3 are twisted relative to the housing of the camshaft adjuster 3 by the hydraulic fluid, which then, as explained, results in a phase adjustment of the camshaft 2.

As can be seen from FIG. 1, the camshaft 2 comprises a first axial section 9 and a second axial section 10. Between the first and the second axial section 9, 10 a material region 11 of a non- or only poorly magnetisable material is provided, influencing the magnetic flux. In the example embodiment which is shown according to FIG. 1 the two axial sections 9, 10 are fixed to one another or respectively connected with one another exclusively via this material region 11. The material region 11 forms a complete or partial magnetic separation of the two axial sections 9, 10. The material region 11 serves to direct the magnetic flux 12, drawn only diagrammatically, from one of the axial sections via a (circumferential) gap 13, filled if applicable with oil or air, to the armature 7, which is penetrated axially by the magnetic flux 12 and then in turn back from the armature 7 via the gap 13 to the respectively other axial section.

It can be seen from FIG. 1 that the coil winding 8 is arranged coaxially to the camshaft 2 or respectively to the longitudinal centre axis 14 of the camshaft 2 with a radial distance from the camshaft 2. A small circumferential air gap 15 is realized between the camshaft 2 and the coil winding 8, so that the camshaft 2 can twist relative to the fixedly arranged coil winding 8. Alternatively, the camshaft can be arranged not coaxially, but rather parallel adjacent to the camshaft 2.

Associated with the coil winding 8 are a first and a second yoke section 16, 17 which are constructed in an annular disc shape and extend in radial direction. The two yoke sections 16, 17 are connected with one another in axial direction by a magnetisable housing 18, which is hollow-cylindrical here. In the example embodiment shown, the first yoke section 16, the second yoke section 17 and the housing 18 are separate components connected with one another, wherein in an alternative variant embodiment at least one of the yoke sections 16, 17 can be connected in one piece with the housing 18.

On energizing of the coil winding 8, the magnetic flux 12 is produced which is only illustrated diagrammatically, wherein the flux direction and hence the direction of movement of the armature 7 is dependent on the direction of energizing of the coil winding 8. In the example embodiment which is shown, the magnetic flux runs from the radially inner end of the first yoke section 16 in radial direction outwards into the cylindrical housing 18, in the latter in axial direction to the radially outer end of the second yoke section 17 and then in the second yoke section 17 radially inwards, then bridges a second gap 19 between the second yoke section 17 and the second axial section, penetrates the second axial section substantially in radial direction inwards, then bridges the gap 13 towards the armature 7, runs in the armature 7 in axial direction, then bridges the gap 13 again in radial direction outwards into the first axial section 9 and runs in the latter radially outwards and bridges a first gap 20 between the first axial section 9 and the first yoke section 16.

In a preferred embodiment, a resetting can take place, either away from the actuating partner or towards the actuating partner by means of a—for example mechanical—adjustment mechanism, in particular via a spring mechanism (not illustrated). To delimit the axial adjustment movement of the armature 7 in the direction away from the actuating partner 5, in the example embodiment shown, a diagrammatically illustrated axial stop 21 is provided on the side of the armature 7 facing away from the actuating partner 5.

In the example embodiment according to FIG. 1, the armature 7 is constructed in several parts and comprises a sleeve section 22, on which a pin section 23 is secured, for example by pressing in. In the pin section 23 on the front side a ball 24 is held rotatably in a cage, wherein the armature 7 rests via the ball 24 axially on the actuating partner 5.

In the example embodiment according to FIG. 1 the material region 11 was produced by build-up welding. For this, a camshaft body blank of magnetisable material was divided in the region of the present material region 11 into two separate axial sections, which now form the first and second axial section 9, 10. These two axial sections were connected securely with one another, here in a materially connected manner, by build-up welding of non-magnetisable material 11, i.e. by producing the material region 11. It can be seen that the axial extent of the material region decreases from radially externally to radially internally, and that at each axial section 9, 10 on the front side respectively at least one oblique contact surface is formed, in order to increase the contact surfaces to the material region 11 and hence the stability of the system.

In an alternative manner, it is also possible to realize the magnetic separation between the two axial sections 9, 10, for example by a ring of a non- or only difficultly magnetisable material being provided as material region 11, in order to connect the two separate, i.e. subsequent axial sections 9, 10 with one another.

The example embodiment according to FIG. 2 corresponds substantially to the example embodiment according to FIG. 1, so that to avoid repetitions substantially only the differences between the example embodiments are addressed below. With regard to the commonalities between the example embodiments, reference is to be made to FIG. 1 with associated description of the FIGURE.

In contrast to the example embodiment according to FIG. 1, the two axial sections 9, 10 are not completely separated magnetically, but rather adjacent to the material region 11 radially internally a connecting section 25, web-like in sectional view, is provided, which is substantially ring-shaped and is arranged directly radially adjacent to the material region 11. The radial extent, i.e. thickness extent of the connecting section 25 is dimensioned so that on energizing of the coil winding 8 in the connecting section 25 a magnetic saturation is quickly reached, so that a loss resulting herefrom is minimized. The main flux runs as drawn in FIG. 1.

Figure 2:
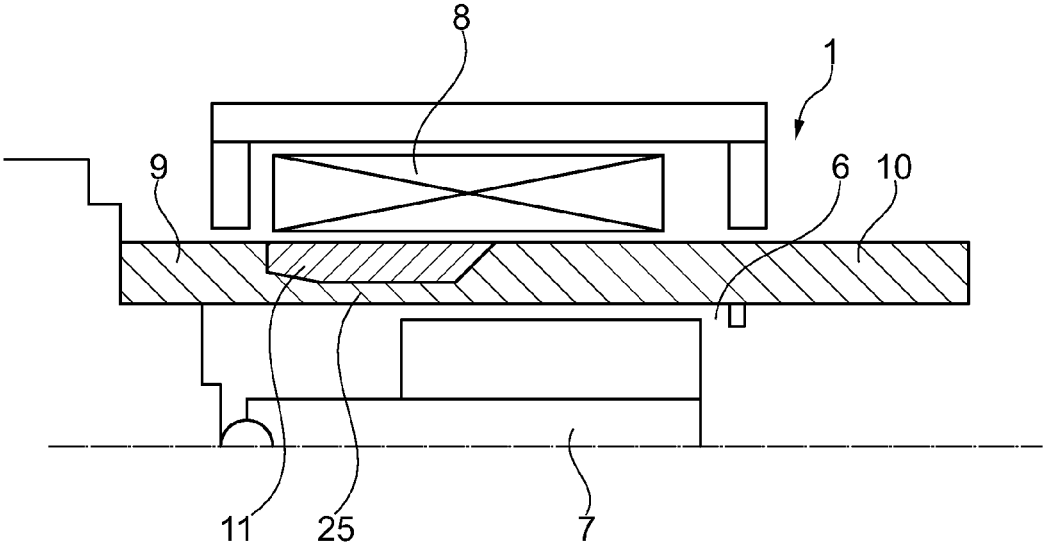

The example embodiment according to FIG. 2 can be produced by a free space in the form of the present material region 11 being produced in a camshaft body blank for example by machining, and this free space then being filled with the material forming the material region 11 in particular by build-up welding. Instead of the filling of the free space 11 with fluid, solidifying material, it is possible alternatively to install a solid ring insert of non- or only difficultly magnetisable material, for example of brass, and to connect it preferably with both axial sections, for example by friction welding.

The advantage of the second example embodiment compared with the first example embodiment consists in an increased mechanical stability. Furthermore, the problem does not occur that an alignment of the two camshaft sections across the material region must be ensured separately.

In all the example embodiments shown, the actuating partner 5 projects from axially outwards by way of example into the camshaft 2. An embodiment (not illustrated) is particularly preferred in which the actuating partner, in particular a control valve for the camshaft adjustment, as shown for example in EP 2 252 774 B1, is situated completely inside the camshaft.

The invention claimed is:

1. A camshaft assembly, comprising a camshaft having a receiving space in an interior thereof, at least some sections of the assembly being made of a magnetisable material, and an electromagnetic actuating unit for actuating an actuating partner comprising a control valve of a camshaft adjuster, a coil winding and an armature for cooperating with the actuating partner, the armature being adjustable by energizing the coil winding, the armature is arranged inside the camshaft in the receiving space and the coil winding for non-contact adjusting of the armature is arranged radially outside the camshaft, the camshaft has a first axial section and a second axial section and between the first axial section and the second axial section is provided a material region influencing the magnetic flux and increasing the magnetic flux from one of the first and second axial sections to the respectively other of the first and second axial sections via the armature.

2. The camshaft assembly according to claim 1, wherein the material region is constructed from a material which is more difficult to magnetise than the magnetisable camshaft material.

3. The camshaft assembly according to claim 1, wherein the first and the second axial section are connected securely with one another mechanically via the material region.

4. The camshaft assembly according to claim 1, wherein the first axial section and the second axial section are connected in a materially connected manner via the material region.

5. The camshaft assembly according to claim 1, wherein the first axial section and the second axial section are held against one another exclusively via the material region.

6. The camshaft assembly according to claim 1, wherein the first axial section and the second axial section are constructed in one piece in a section adjacent to the material region via a connecting section constructed as an annular section, which connecting section consists of the material of the first and second axial section.

7. The camshaft assembly according to claim 1, wherein the material region is circumferentially closed.

8. The camshaft assembly according to claim 1, wherein the coil winding surrounds the camshaft and is arranged coaxially to the camshaft and to the armature, or that the coil winding is arranged adjacent to the camshaft, such that a coil winding axis runs parallel to the camshaft.

9. The camshaft assembly according to claim 1, wherein the armature is received completely over in the camshaft and/or the actuating partner is received at least partially in the camshaft and projects axially into the latter.

10. The camshaft assembly according to claim 1, wherein the axial extent of the material region is different over its radial extent, and the axial extent decreases with a radial distance from the armature becoming less.

11. An engine block with a camshaft assembly according to claim 1, wherein the camshaft and/or the armature and/or the coil winding is/are arranged inside the engine block.

12. A method for producing a camshaft assembly comprising the steps of:

providing between a first axial section and a second axial section of a camshaft a material region influencing magnetic flux, and positioning an armature in the material region in order to increase a magnetic flux from one of the first and second axial sections to the other of the first and second axial sections.

13. The method according to claim 12, including partially heat treating the camshaft to obtain in the material region a microstructural transformation.

14. The method according to claim 12, wherein the material region is obtained by filling a free space between the first and the second axial section with material.

15. The method according to claim 14, wherein the production of the free space takes place in the same clamping as the filling of the free space.

* * * * *